US007804513B2

(12) United States Patent
Masuda

(10) Patent No.: US 7,804,513 B2
(45) Date of Patent: Sep. 28, 2010

(54) OPTICAL WRITING UNIT, IMAGE FORMING APPARATUS, PROCESS CARTRIDGE, AND METHOD OF ADJUSTING LIGHT INTENSITY

(75) Inventor: Koji Masuda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 64 days.

(21) Appl. No.: 10/981,723

(22) Filed: Nov. 5, 2004

(65) Prior Publication Data

US 2005/0093963 A1 May 5, 2005

(30) Foreign Application Priority Data

Nov. 5, 2003 (JP) ..... 2003-375207
Feb. 26, 2004 (JP) ..... 2004-051114

(51) Int. Cl.
*B41J 2/435* (2006.01)

(52) U.S. Cl. ..... 347/236; 347/246

(58) Field of Classification Search ..... 347/131, 347/137, 236–238, 241–244, 246–247, 256–258, 347/130, 233, 230; 358/401
See application file for complete search history.

(56) References Cited

U.S. PATENT DOCUMENTS 4,734,714 A * 3/1988 Takasu et al. ..... 347/237
5,838,024 A 11/1998 Masuda et al.
5,859,658 A * 1/1999 Hammond ..... 347/238
5,875,051 A 2/1999 Suzuki et al.
5,962,874 A 10/1999 Masuda et al.
5,986,791 A 11/1999 Suzuki et al.
6,069,724 A 5/2000 Hayashi et al.
6,072,596 A * 6/2000 Hattori et al. ..... 358/401
6,075,638 A 6/2000 Masuda
6,081,386 A 6/2000 Hayashi et al.
6,100,913 A * 8/2000 Aikoh et al. ..... 347/237
6,141,133 A 10/2000 Suzuki et al.
6,188,086 B1 2/2001 Masuda et al.
6,222,662 B1 4/2001 Suzuki et al.
6,259,546 B1 7/2001 Masuda
6,266,077 B1 * 7/2001 Kamimura ..... 347/236
6,384,949 B1 5/2002 Suzuki
6,396,529 B1 * 5/2002 Miyoshi et al. ..... 347/236
6,456,314 B1 9/2002 Masuda (Continued)

FOREIGN PATENT DOCUMENTS

JP 2-62257 3/1990

(Continued)

*Primary Examiner*—Hai C Pham
(74) *Attorney, Agent, or Firm*—Oblon, Spivak, McClelland, Maier & Neustadt, L.L.P.

(57) ABSTRACT

An optical writing unit includes a light-emitting-element array in which a plurality of light emitting elements is arranged and an optical system that guides light flux emitted from the light emitting elements as a light spot. A result of comparison of a property value of the light emitting elements at a predetermined threshold in an exposure intensity distribution of the light emitting elements is within a preset range over an entire effective image area. An emission condition of the light emitting elements is set such that a fluctuation of amounts of exposure of the light emitting elements or a result of comparison of the amounts of exposure does not exceed a preset range over the entire effective image area.

14 Claims, 14 Drawing Sheets

U.S. PATENT DOCUMENTS

| | | | | |
|---|---|---|---|---|
| 6,462,879 | B2 | 10/2002 | Masuda | |
| 6,466,245 | B1 * | 10/2002 | Fukasawa | 347/137 |
| 6,473,106 | B2 * | 10/2002 | Fukasawa | 347/130 |
| 6,496,214 | B1 | 12/2002 | Masuda et al. | |
| 6,498,616 | B1 * | 12/2002 | Nagumo et al. | 347/237 |
| 6,633,322 | B2 * | 10/2003 | Sakai et al. | 347/233 |
| 6,686,946 | B2 | 2/2004 | Masuda et al. | |
| 6,697,181 | B2 | 2/2004 | Masuda | |
| 6,717,606 | B2 | 4/2004 | Masuda | |
| 6,724,414 | B2 | 4/2004 | Masuda et al. | |
| 6,753,897 | B2 * | 6/2004 | Vazan | 347/237 |
| 2004/0008247 | A1 | 1/2004 | Masuda | |
| 2004/0141218 | A1 | 7/2004 | Suzuki et al. | |

FOREIGN PATENT DOCUMENTS

| | | | |
|---|---|---|---|
| JP | 4-305667 | | 10/1992 |
| JP | 10142882 | A * | 5/1998 |
| JP | 11-227254 | | 8/1999 |
| JP | 2002-127492 | | 5/2002 |

* cited by examiner

OPTICAL WRITING UNIT, IMAGE FORMING APPARATUS, PROCESS CARTRIDGE, AND METHOD OF ADJUSTING LIGHT INTENSITY

CROSS-REFERENCE TO RELATED APPLICATIONS

The present document incorporated by reference the entire contents of Japanese priority documents, 2003-375207 filed in Japan on Nov. 5, 2003 and 2004-051114 filed in Japan on Feb. 26, 2004.

BACKGROUND OF THE INVENTION

1) Field of the Invention

The present invention relates to a digital writing optical system, and more particularly, to an optical writing unit of a solid optical writing system, an image forming apparatus, a process cartridge, and a method of adjusting light intensity.

2) Description of the Related Art

Due to the recent downsizing of digital image outputting apparatuses like a digital copying machine, a printer, and a digital facsimile, there is a demand of achieving a compact optical writing unit that performs digital writing. Digital writing systems are roughly classified into two kinds at present. One is the optical scan system that causes a light deflector to optically scan with a flux of rays emitted from a light source like a semiconductor laser and forms a light spot using a scanning/image forming lens, and another one is the solid writing system that causes an optical element array to form a light spot from a flux of rays emitted from a light-emitting-element array like a light emitting diode (LED) array or an organic electro-luminescence (EL) array.

The optical scan system has a long optical path due to the scanning with light by the light deflector, whereas the solid writing system has an advantage of making it possible to construct the optical writing unit compact, because the optical path can be made very short.

The solid writing system has another advantage such that because of having no movable parts such as a light deflector, noises can be suppressed.

Japanese Patent Application Laid-Open Publication No. H2-62257 discloses a technique of LED drive timing control to make the amounts of light emission of an LED uniform.

Japanese Patent Application Laid-Open Publication No. H4-305667 discloses a technique of achieving a uniform spot width of the light intensity at a predetermined threshold.

Japanese Patent Application Laid-Open Publication No. H1-227254 discloses:

(1) A characteristic point in the emission intensity distribution of a light emitting element is measured, and light-intensity correction data for supplying energy to the light emitting element is determined based on the characteristic feature;

(2) Temporary light-intensity correction data is determined based on the fluctuation of the light intensity and is corrected based on the characteristic feature to thereby determine light-intensity correction data;

(3) The characteristic point is a change in peak position;

(4) The characteristic point is a change in peak value; and (5) The characteristic point is a change in emission light size.

Japanese Patent Application Laid-Open Publication No. 2002-127492 discloses that the amounts of light emission of light emitting elements are set such that the result of comparison of the property values of the light emitting elements at the predetermined threshold in the exposure intensity distribution lies within a preset range over the entire effective image area.

However, the optical writing unit of the solid writing system that comprises a light-emitting-element array having multiple light emitting elements, and an optical element array causes fluctuation of the light spot on an image carrier (e.g., a photoconductor) due to fluctuation of the amounts of light emission of the light emitting elements or fluctuation of the shape of the optical element array. In this case, the "fluctuation" means "fluctuation of intensity", "positional fluctuation", "fluctuation of the spot shape" or the like. Therefore, an image output from an image forming apparatus that uses the optical writing unit as an exposure unit has density irregularity and cannot acquire excellent images.

To acquire excellent images by the conventional optical writing unit, there is a proposal such that density irregularity is reduced by performing correction, such as constant light intensity correction to make the amounts of exposure to a photoconductor constant or constant spot size correction to make the size of a light spot to be formed on a photoconductor constant at a predetermined threshold.

The constant light intensity correction sets the amount of the supply current so as to ensure a constant amount of exposure by measuring the amounts of exposure to a photoconductor using a light intensity measuring unit and changing the flow rate of the current to be supplied to each light emitting element. In general, the amount of the current to be supplied is controlled based on light-intensity correction data of 4 to 6 bits, and the amount of light emission is set within a range of several %, though the light intensity is constant.

The constant spot size correction sets the amount of the supply current so as to ensure a constant light spot size by measuring the size of a light spot to be formed on a photoconductor using a spot size measuring unit and changing the flow rate of the current to be supplied to each light emitting element. Since the amount of the current to be supplied is controlled based on light-intensity correction data of 4 to 6 bits, as per the constant light intensity correction, there is a limit to the control amount even with the constant spot size.

The Japanese Patent Application Laid-Open Publication No. H11-227254 further proposes the following. With the constant light intensity correction performed using temporary light-intensity correction data, a light spot size Wi for each light emitting element is measured. It is then determined whether the light spot size Wi depicts a convex change upward, and when there is a convex change upward, temporary light-intensity correction data of the i-th light emitting element is corrected. This system still has the following problems:

(1) Temporary light-intensity correction data is corrected only at an area that fulfills the determination requirement and is not optimized over the entire effective image area. That is, constant light intensity correction is unchanged at an area that does not fulfill the determination requirement;

(2) The scheme of correcting temporary light-intensity correction data corrects temporary light-intensity correction data according to a fluctuation of the Wbi with respect to an average value Wave of Wi, and is just the same as constant spot size correction.

Therefore, this proposal is merely the combination of the constant light intensity correction and the constant spot size correction such that the constant light intensity correction is performed at some locations and the constant spot size correction is performed at some locations. Although the control amounts are constant, they are limited as per the constant light intensity correction and the constant spot size correction.

As described above, the constant correction (constant light intensity correction or constant spot size correction) cannot make the light intensity or the spot size to be converged merely to the resolution level of the amount of the current to be supplied that is predetermined as correction data, and the control amount is allowed to approach as close to a predetermined target value as possible, so that the value after constant correction with respect to each light emitting element fluctuates around the predetermined target value.

Therefore, the light intensity or the spot size after constant correction is not regular and does not take a plurality of light emitting elements into consideration; and (3) The determination requirement of correcting temporary light-intensity correction data is stepwise with respect to Wbi, such as no correction made on the temporary light-intensity correction data when Wbi<10, correction made on only 4% of the temporary light-intensity correction data when 10≦Wbi<20 and correction made on only 8% of the temporary light-intensity correction data when 20≦Wbi. A sudden change occurs near that light emitting element whose Wbi is 10 or 20. FIG. 25 depicts that image. The broken line in the figure indicates data before correction, and the solid line indicates data after correction. As indicated by arrows in the diagram, steps are produced near the light emitting elements whose Wbi is 10 or 20. There is a concern that such a sudden change would adversely affect images. Furthermore, the correction does not take a plurality of light emitting elements into consideration.

Japanese Patent Application Laid-Open Publication No. 2002-127492 proposes a light intensity adjusting method that takes a plurality of light emitting elements into account. Specifically, the result of comparison (e.g., the inclination of an approximate line or the moving average) of the property values of a plurality of light emitting elements at a predetermined threshold in the exposure intensity distribution is controlled to lie within a preset range over the entire effective image area. This prevents the property values of nearby light emitting elements from changing abruptly.

SUMMARY OF THE INVENTION

It is an object of the present invention to solve at least the problems in the conventional technology.

An optical writing unit according to one aspect of the present invention includes a light-emitting-element array in which a plurality of light emitting elements is arranged; and an optical system that guides light flux emitted from the light emitting elements as a light spot. A result of comparison of a property value of the light emitting elements at a predetermined threshold in an exposure intensity distribution of the light emitting elements is within a preset range over an entire effective image area. An emission condition of the light emitting elements is set such that a fluctuation of amounts of exposure of the light emitting elements or a result of comparison of the amounts of exposure does not exceed a preset range over the entire effective image area.

An image forming apparatus according to another aspect of the present invention includes an image forming process unit including a charging unit, an exposure unit, a developing unit, a transfer unit, and a fixing unit. The exposure unit includes a light-emitting-element array in which a plurality of light emitting elements is arranged and an optical system that guides light flux emitted from the light emitting elements as a light spot. A result of comparison of a property value of the light emitting elements at a predetermined threshold in an exposure intensity distribution of the light emitting elements is within a preset range over an entire effective image area. An emission condition of the light emitting elements is set such that a fluctuation of amounts of exposure of the light emitting elements or a result of comparison of the amounts of exposure does not exceed a preset range over the entire effective image area.

A process cartridge according to still another aspect of the present invention is integrally held with an exposure unit and any one of an image carrier, a charging unit, and a developing unit, and is detachably mounted on a main unit of an image forming apparatus. A result of comparison of a property value of a plurality of light emitting elements in the exposure unit at a predetermined threshold in an exposure intensity distribution of the light emitting elements is within a preset range over an entire effective image area. An emission condition of the light emitting elements is set such that a fluctuation of amounts of exposure of the light emitting elements or a result of comparison of the amounts of exposure does not exceed a preset range over the entire effective image area.

A method of adjusting light intensity according to still another aspect of the present invention includes extracting a first emission condition that makes amounts of exposure of light emitting elements identical, the first emission condition being temporary light-intensity correction data; emitting the light emitting elements using the temporary light-intensity correction data; measuring the property value of the light emitting elements at a predetermined threshold in an exposure intensity distribution of the light emitting elements; setting a result of comparison of the property value of the light emitting elements as a correction target value; extracting a second emission condition to achieve a correction target value, the second emission condition being light-intensity correction data; and determining, when emitting the light emitting elements based on the light-intensity correction data acquired, whether a fluctuation of amounts of exposure of the light emitting elements or a result of comparison of the amounts of exposure exceeds a preset range over an entire effective image area.

A method of adjusting light intensity according to still another aspect of the present invention includes extracting a first emission condition that makes a property value of each of a plurality of light emitting elements at a predetermined threshold in an exposure intensity distribution identical, the first emission condition being temporary light-intensity correction data; emitting the light emitting elements using the temporary light-intensity correction data; measuring amounts of exposure of the light emitting elements; setting a result of comparison of the amounts of exposure of the light emitting elements as a correction target value; extracting a second emission condition to achieve the correction target value, the second emission condition being light-intensity correction data; and determining, when emitting the light emitting elements based on the light-intensity correction data acquired, whether a result of comparison of the property value of the light emitting elements at the predetermined threshold in the exposure intensity distribution exceeds a preset range over an entire effective image area.

The other objects, features, and advantages of the present invention are specifically set forth in or will become apparent from the following detailed description of the invention when read in conjunction with the accompanying drawings.

DETAILED DESCRIPTIONS

Exemplary embodiments of an optical writing unit according to the present invention will be explained in detail with reference to the accompanying drawings. The optical writing unit has an array of multiple light emitting elements, and an optical system for guiding a flux of rays emitted from each light emitting element as a light spot, and is shown in the schematic diagram in FIG. 1.

Figure 2A:
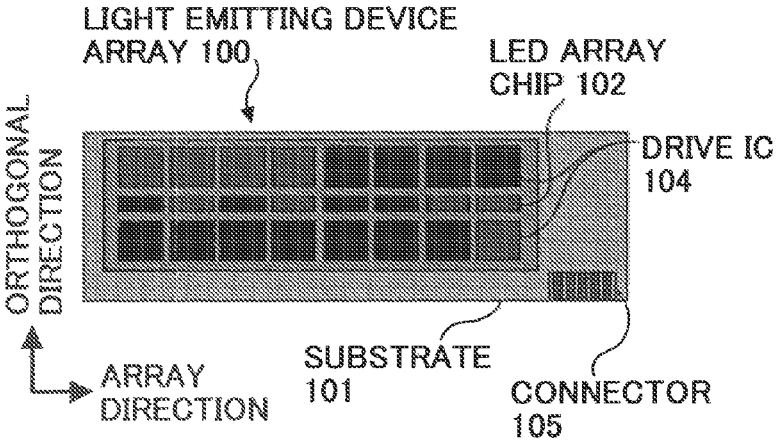
FIG. 2A is a schematic diagram of an array of LEDs.
Figure 2B:
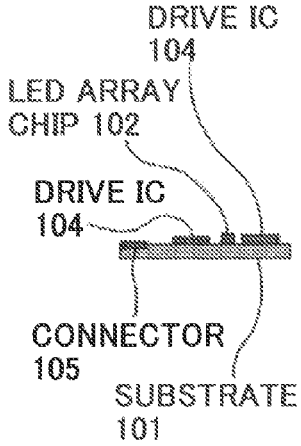
FIG. 2B is a cross-sectional view of the LED array.
Figure 2C:
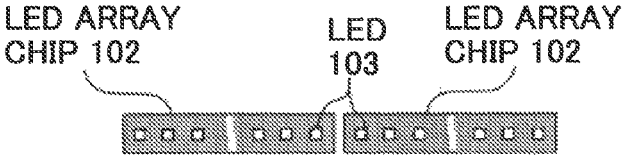
FIG. 2C is a diagram of an LED array chip.

FIG. 2 is a diagram for explaining a light-emitting-element array according an embodiment of the present invention.

A light-emitting-element array 100 is, for example, an inorganic LED array. The LED array 100 has several tens to hundred or so LED array chips 102 mounted on a substrate 101, with several tens to several hundred or so LEDs 103 on each LED array chip 102 arrayed at a predetermined pitch. The adjoining LED array chips 102 are mounted on the substrate 101 such that the interval between the LEDs 103 at their end portions becomes the predetermined pitch. At present, the LEDs 103 are arrayed with a density of 600 to 1200 diodes per inch, and the LED array in use in the embodiment has the LEDs 103 arrayed at the pitch of 21.2 micrometers (1200 dots per inch). Besides the LED array chip 102, a drive IC 104 that drives the LEDs 103 and a connector 105 that connects signals lines for sending an external data signal like an image signal are mounted on the substrate 101.

Figure 3:
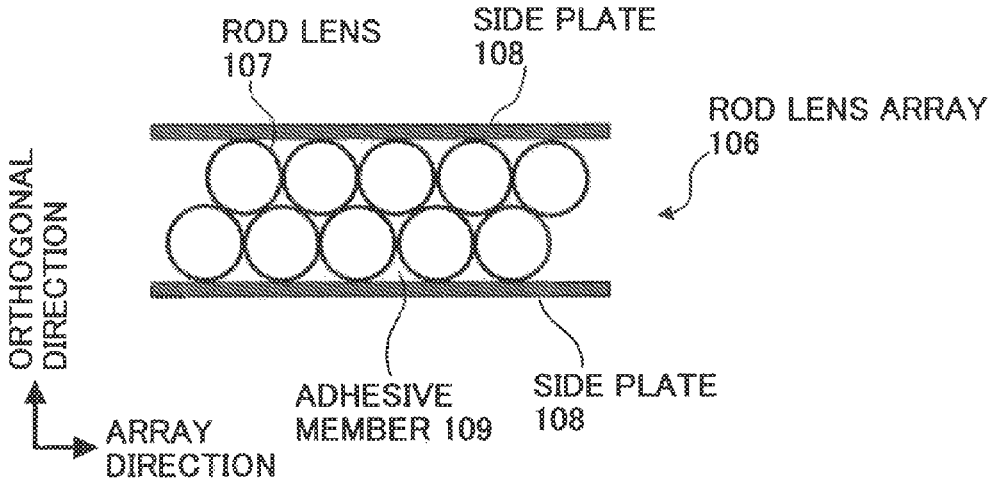
FIG. 3 is a schematic diagram of a rod lens array.

FIG. 3 is a diagram for explaining an optical system according an embodiment of the present invention. The optical system includes, for example, a graded index rod lens array 106. The rod lens array 106 has two rows of cylindrical graded index rod lenses 107 stacked one on the other, and forms an erecting system in the array direction and the orthogonal direction. In the embodiment, rod lenses 107 in use have a diameter of about 0.56 millimeter. The rod lenses 107 are sandwiched by side plates 108 to hold the rod lenses 107 and acquire a sufficient mechanical strength. An adhesive member 109 is fitted in the clearance between the adjoining rod lenses 107 for solidification. The adhesive member 109 is opaque and also serves to prevent flare light.

The optical writing unit in FIG. 1 includes the LED array 100 and the rod lens array 106 will be described below. The rod lens array 106 is held on an optical element array holder 201 at one end of which an LED array holder 202 is supported. The back side of the substrate 101 (the side where the LEDs 103 are not mounted) keeps the linearity of the substrate 101 and abuts on the LED array holder 202. The optical element array holder 201 and the LED array holder 202 are secured by an adhesive, a clip, or the like.

The rod lens array 106 with the two stacked rows of rod lenses 107 is mounted with adjustment made such that a center line of the rod lens array 106 matches with the center line of the LED array 100, and the distance between each LED and the rod lens array 106 is so adjusted as to provide an favorable line of light spots.

The optical writing unit is installed in the image forming apparatus as an exposure unit to make an image output. The amounts of light emission of the individual LEDs 103 are set such that the amounts of exposure of light spots that are formed in association with the respective LEDs 103 on an image carrier after passing the optical system become approximately identical to one another.

First, one example of the method of setting the amounts of light emission will be described specifically.

The amount of light emission of each LED 103 is controlled based on the value of the current to be supplied to the LED 103, the value of the voltage to be applied, the resistance, the emission time, etc. according to the drive method for the LEDs 103. Those are emission conditions for turning on the LEDs 103 with the desired amounts of light emission, and are set as light-intensity correction data of integer values. In determining the amounts of light emission of the LEDs 103, two or more emission conditions can be combined, but generally the determination is often made under one of the emission conditions for the sake of simplicity. Needless to say, two or more emission conditions may be combined for finer control.

The amount of light emission of each LED 103 is correlated with a change in light-intensity correction data, and is known to change approximately linearly. That is, the emission condition for a predetermined amount of exposure can be set by turning on each LED 103 based on two standard light-intensity correction data, measuring the amount of exposure and then performs linear interpolation of the measurement.

It is needless to say that the method of setting the amounts of light emission is not limited to this particular example.

An image pattern that is output will be explained next.

An image pattern is a repetitive pattern of 1-on-2-off (i.e., emission of one dot and disabling of two dots) in the array direction, and is a vertical line image parallel to the feeding direction of a photoconductor (orthogonal direction). A pattern obtained by shifting one dot and shifting two dots in the array direction is also arranged in the orthogonal direction in a way as to be fitted on the same output paper. The pattern is called "1-on-2-off vertical line image".

Figure 4:
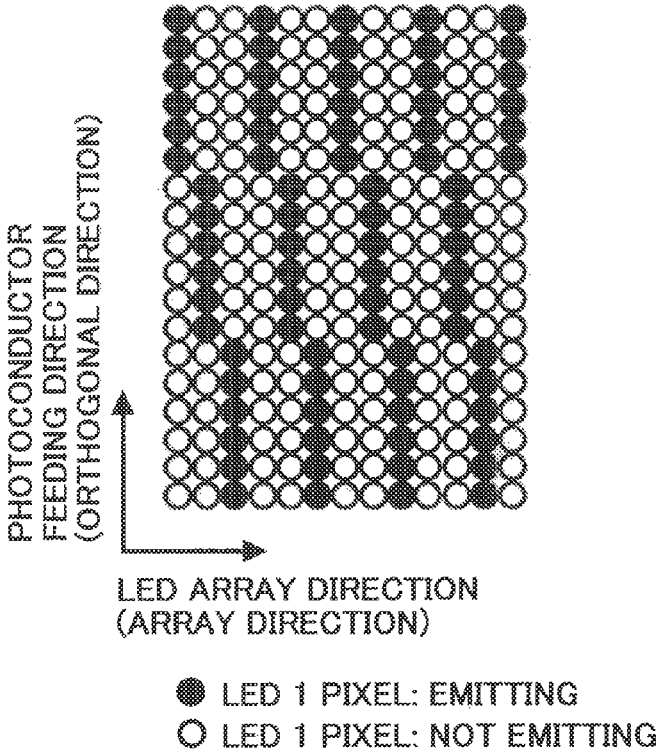
FIG. 4 is a schematic diagram of a 1-on-2-off vertical line image.

FIG. 4 is a schematic diagram of a 1-on-2-off vertical line image.

When an image is output using the 1-on-2-off vertical line image, density irregularity parallel to the orthogonal direction is noticed. This is the object that the present invention is to solve. The exposure intensity distribution for the light emitting elements in the optical writing unit is measured using a two-dimensional charge coupled device (CCD). An example of the exposure intensity distribution is shown as the measuring result in FIG. 5 (perspective view). The cross section of the exposure intensity distribution (exposure area) at a predetermined threshold is calculated in FIG. 5 (FIG. 6). This is a "property value" in the present invention. In the embodiment, the threshold is set to $1/e^2$ of the average peak exposure intensity for each LED 103.

Figure 5:
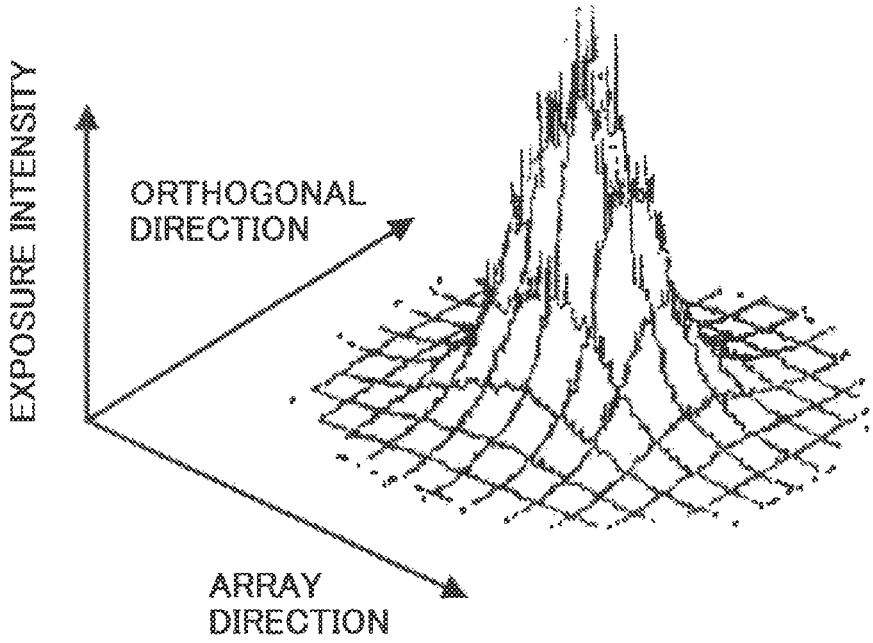
FIG. 5 is an example (perspective view) of an exposure intensity distribution.
Figure 6:
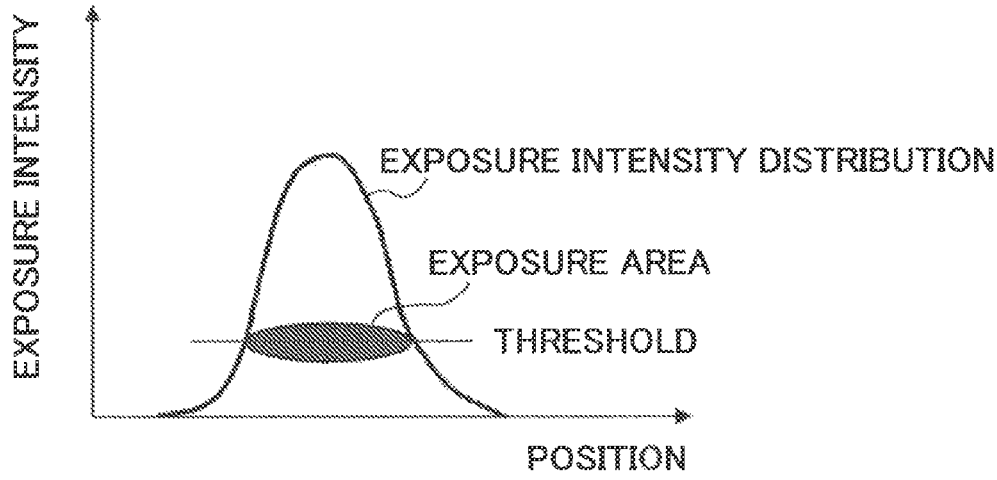
FIG. 6 is a schematic diagram of an exposure area.
Figure 7:
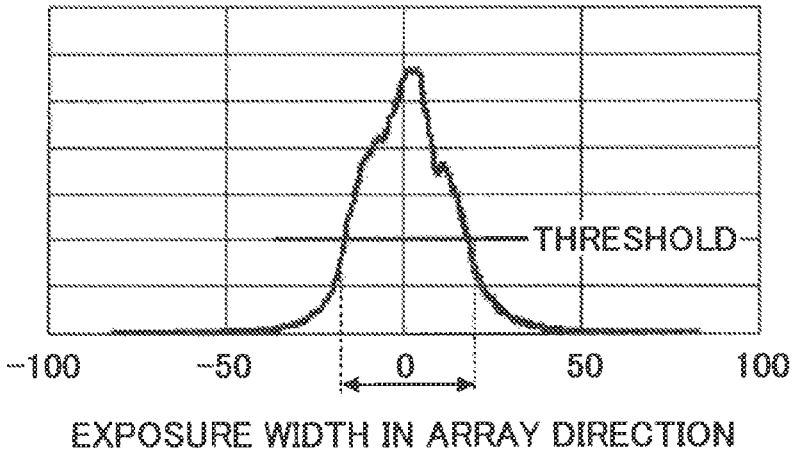
FIG. 7 is a diagram of an example of an exposure intensity distribution at a cross section in the array direction.

It is apparent from FIG. 5 that the property value can be the width of the exposure intensity distribution at a predetermined threshold at a cross section in the array direction or in the orthogonal direction (the exposure width in the array direction or the exposure width in the orthogonal direction). An example of the exposure intensity distribution at a cross section in the array direction is shown in FIG. 7. When the property value is set to the exposure width in the array direction or the exposure width in the orthogonal direction, however, there is a disadvantage that only one-dimensional direction of a light spot shape is taken into consideration, while the example has an advantage that measurement of the property value is simplified.

While the threshold is set to $1/e^2$ (13.5%) in the embodiment, it can be changed according to the characteristics of the image forming apparatus. In practice, the fluctuation of the exposure intensity distribution at the flare portion of the light spot (level of several %) is large, and a change in exposure intensity distribution is small at the upper portion of the light spot that exceeds several tens of %, so that those areas are hard to control. According to the results of an experiment by the inventor, the desirable area for the threshold is the range of 7% to 21%.

Figure 8:
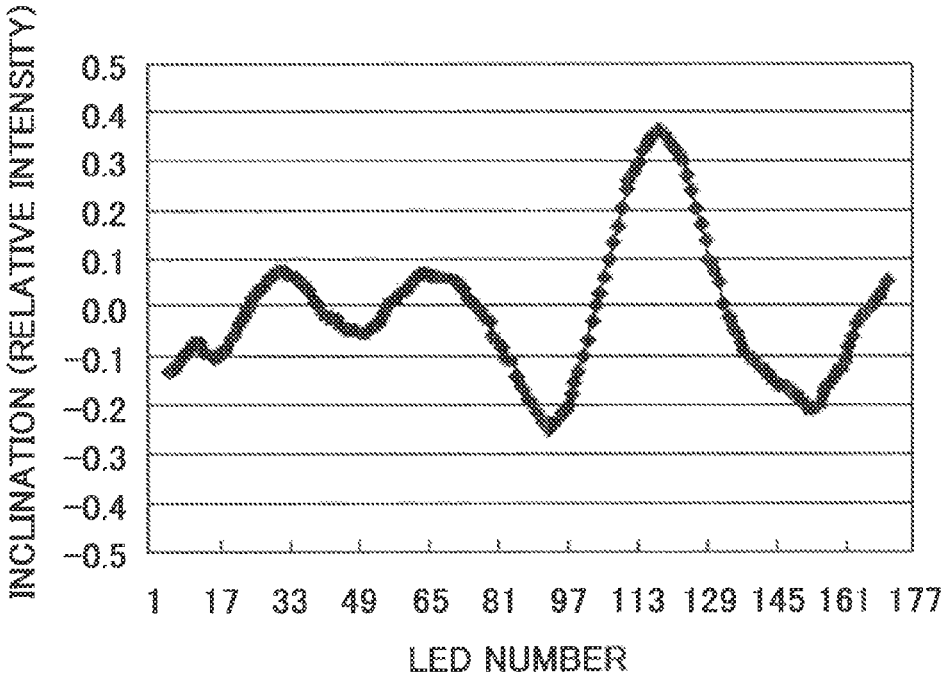
FIG. 8 is a graph of a plot of the inclination of an approximate line.

FIG. 8 is a graph of the inclination of a linear regression line of the exposure area acquired by the least square approximation in order for every consecutive 25 light emitting elements (hereinafter, "approximate line"). This is what is called the "result of comparison of the property values (exposure areas) of a plurality of light emitting elements" in the invention. As compared with a 1-on-2-off vertical line image output, the result corresponds well to a change in density on the image.

While the comparison result is acquired for consecutive 25 light emitting elements in the foregoing description, the light emitting elements may be selected by thinning every three light emitting elements according to the 1-on-2-off vertical line image and those light emitting elements that are turned on according to the image pattern. That is, with the distances from a plurality of light emitting elements being set to the same, the comparison result can be used for nine light emitting elements selected every three light emitting elements. In this case, however, as light intensity adjustment is carried out for all the light emitting elements, the same work is taken even when the pattern is shifted by one light emitting element or two light emitting elements, which somewhat takes time.

The comparison result is not limited to the inclination of an approximate line, but can take any form as long as it is an index that takes a plurality of light emitting elements into account and can well correspond to a change in density on an image.

Specifically, around a portion where the inclination of an approximate line is positive and the absolute value of the inclination is large, the density on an image changes from a low area (it is identified as light) to a high area (it is identified as dark), whereas around a portion where the inclination of an approximate line is negative and the absolute value of the inclination is large, the density changes from a high area (it is identified as dark) to a low area (it is identified as light). At a portion where the absolute value of the inclination is small, a change in density on an image cannot be identified or the change, if identified, is very small and does not raise any practical problem.

An optical writing unit, which does not generate an abnormal image of such a level that is recognized as density irregularity or that the inclination of an approximate line of the exposure area of every consecutive 25 light emitting elements lies within a range preset according to the characteristics of the image forming apparatus, will be accepted.

Figure 9:
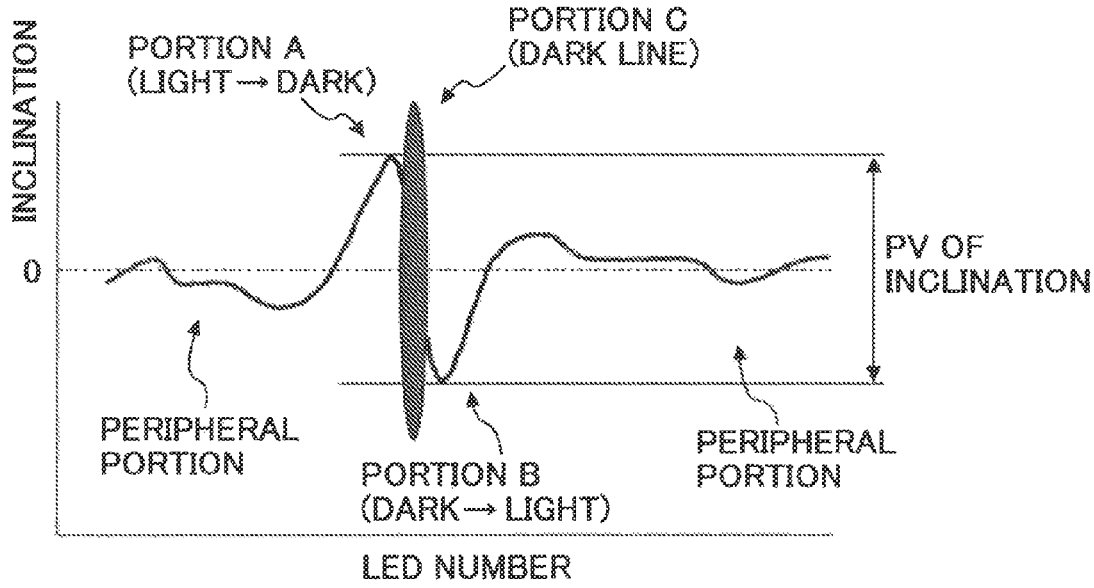
FIG. 9 is a schematic diagram of the correlation between the inclination of an approximate line and a vertical line.

FIG. 9 is a schematic diagram of the correlation between the inclination of an approximate line and a dark density irregularity. The diagram depicts density irregularity (vertical line) that can be identified as a high density with respect to a peripheral portion. At a portion where the inclination of an approximate line is positive and the absolute value of the inclination is large (portion A in the diagram), the density can be visible to human eyes as changing from a light level to a dark level (in this case, the density at the peripheral portion is taken as light). At a portion where the inclination of an approximate line is negative and the absolute value of the inclination is large (portion B in the diagram), the density can be visible to human eyes as changing from a dark level to a light level. That is, a portion (portion C in the diagram) between the portion A and the portion B is a dark portion, and is recognized as a vertical line (dark line).

The greater the absolute value of the inclination, the greater the density change with respect to the peripheral portion that is recognized. Therefore, the larger the difference between the inclination of the portion A and the inclination of the portion B (PV of the inclination), the stronger (more noticeable) the line that is recognized.

Figure 10:
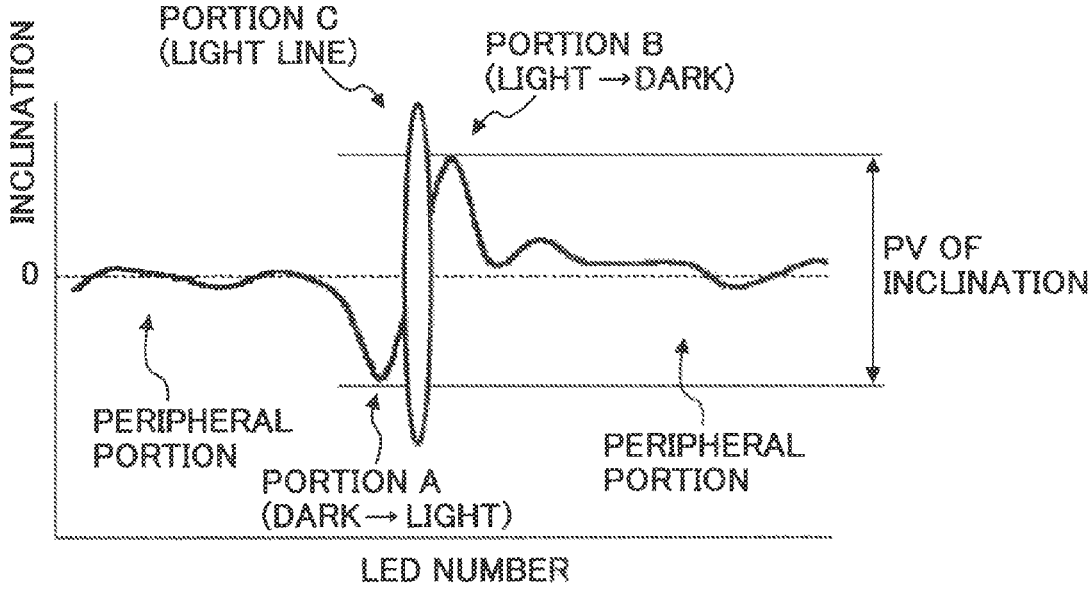
FIG. 10 is a schematic diagram of the correlation between the inclination of the approximate line and the vertical line.

FIG. 10 is a schematic diagram of the correlation between the inclination of an approximate line and a light density irregularity. The diagram depicts density irregularity (vertical line) that can be identified as a low density with respect to a peripheral portion. At a portion where the inclination of an approximate line negative positive and the absolute value of the inclination is large (portion D in the diagram), the density image can be visible to human eyes as changing from a dark level to a light level (in this case, the density at the peripheral portion is taken as dark). At a portion where the inclination of an approximate line is positive and the absolute value of the inclination is large (portion E in the diagram), the density can be visible to human eyes as changing from a light level to a dark level. That is, a portion (portion F in the diagram) between the portion D and the portion E is light portion, and is recognized as a vertical line (light line).

The greater the absolute value of the inclination, the greater the density change with respect to the peripheral portion that is recognized. The larger the difference between the inclination of the portion D and the inclination of the portion E (PV of the inclination), therefore, the stronger (more noticeable) the line that is recognized.

Favorable images can therefore be acquired by controlling the comparison result of the property values of a plurality of light emitting elements.

Under a certain condition, however, density irregularity cannot be reduced by the control alone. When the light spot shape changes significantly and the comparison result of the property values is controlled based on the amounts of light emission of the light emitting elements, the amounts of exposure may change significantly, making density irregularity noticeable.

In other words, the amounts of light emission of the light emitting elements are adjusted to control the comparison result of the property values with respect to the optical writing unit with the amounts of exposure adjusted to be constant, but the amount of control is not normally large and is in the order of ±several % with respect to a change in the amounts of light emission. When a significant fluctuation of the light spot shape is caused by the light emitting elements or the optical system, a change in the amounts of light emission rarely becomes ±10% or more.

To acquire favorable images even in such a case, the invention also takes a requirement on a fluctuation of the amounts of exposure of light emitting elements into consideration when adjusting the amounts of light emission of the light emitting elements.

That is, the emission condition for light emitting elements can be set such that the comparison result of the property values of a plurality of light emitting elements lies within a preset range over the entire effective image area and a fluctuation of the amounts of exposure of the light emitting elements does not exceed a preset range over the entire effective image area.

Although there is a method of evaluating a fluctuation of the amounts of exposure using the difference between the maximum value and the minimum value in a predetermined range (by merely acquiring the difference or normalizing the difference with an average value in a predetermined range), the evaluation cannot include the changes of the amounts of exposure of light emitting elements in that range. That is the two light emitting elements that are typified by the maximum value and the minimum value become the main objects.

Evaluation of density irregularity can be executed more favorably by an evaluation method that uses the comparison result of the amounts of exposure of a plurality of light emitting elements.

The present invention takes a requirement on the comparison result of the amounts of exposure of a plurality of light emitting elements into consideration when adjusting the amounts of light emission of the light emitting elements.

That is, the emission condition for light emitting elements can be set such that the comparison result of the property values of a plurality of light emitting elements lies within a preset range over the entire effective image area and the comparison result of the amounts of exposure of a plurality of light emitting elements does not exceed a preset range over the entire effective image area.

The light intensity adjusting procedures for explaining the setting will be explained below. The structure of the optical writing unit is the same as is shown in FIG. 1.

Figure 11:
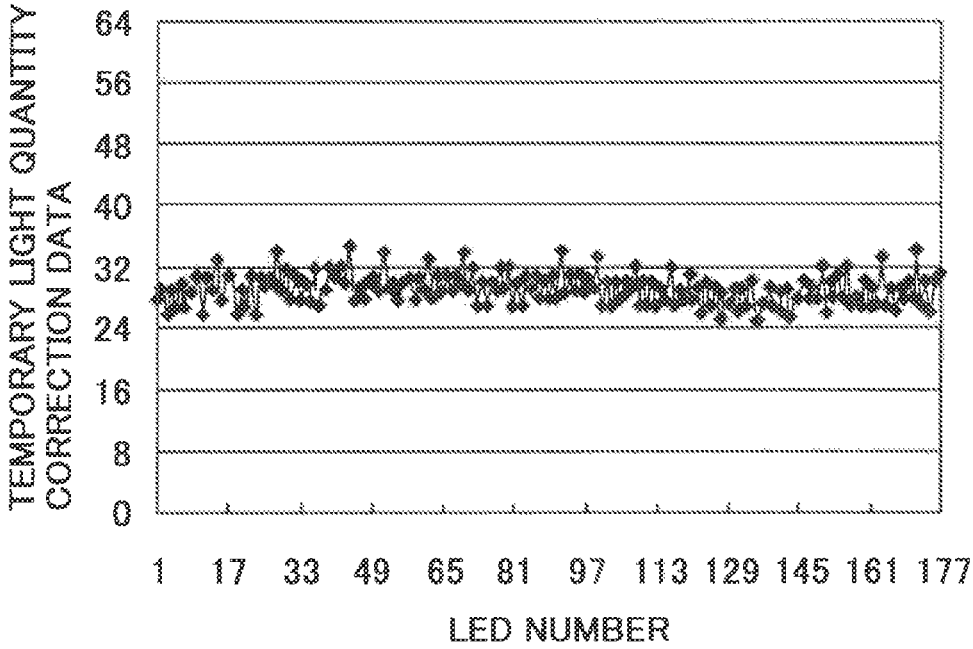
FIG. 11 is a diagram of temporary light-intensity correction data for the LEDs number by number.

(1) The emission condition of each LED is acquired such that the amounts of exposure of light spots on an image carrier after passing the optical system become approximately the same. The emission condition at this time is temporary light-intensity correction data. Temporary light-intensity correction data for a predetermined amount of exposure can be acquired by, for example, turning on each LED 103 based on second standard light-intensity correction data, measuring the amount of exposure and then performs linear interpolation of the measurement for integerization, as mentioned earlier. The acquired temporary light-intensity correction data is shown in FIG. 11. The horizontal axis in the diagram shows the numbers of the LEDs 103 and the results for the consecutive 177 LEDs 103 from the first to the 177-th are shown. The vertical axis in the diagram represents temporary light-intensity correction data that uses six bits (values from 0 to 63) in the embodiment.

Figure 12:
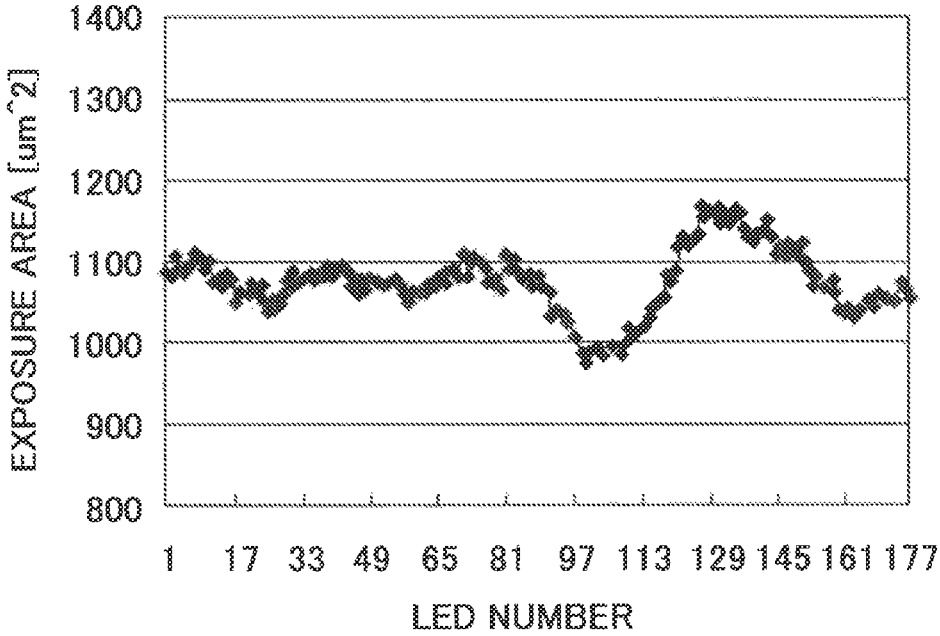
FIG. 12 is a diagram of the exposure area for the LEDs number by number.

(2) The LEDs 103 are turned on for light emission based on the temporary light-intensity correction data and the exposure intensity distribution is measured using a two-dimensional CCD, as mentioned earlier. A predetermined threshold for the 177 LEDs 103 is set to $1/e^2$ of the average value of the peak intensities (average peak exposure intensity) and the exposure area is acquired as the property value. The acquired exposure area is shown in FIG. 12.

Figure 13:
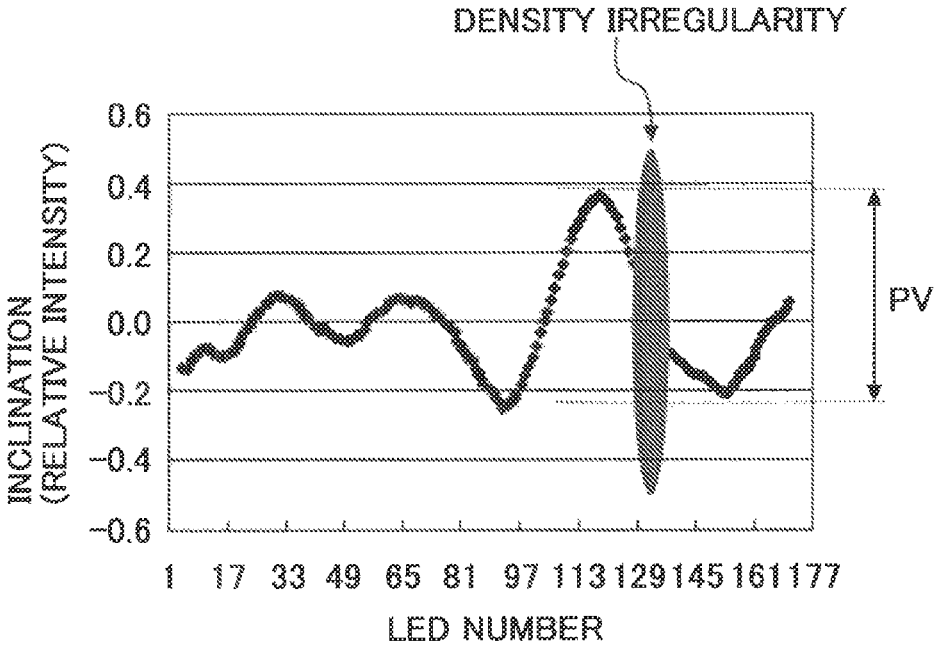
FIG. 13 is a diagram of the inclination of an approximate line for the LEDs number by number.

FIG. 13 depicts the result of acquiring the inclination of an approximate line for every consecutive 25 LEDs 103. The inclination exceeds a preset range and PV of the inclination is large. Therefore, density irregularity occurs near the 130-th LED 103. Suppose the value of the inclination preset is within ±0.3. If the amounts of light emission are calculated such that the inclination is suppressed to change in the range from −0.3 to 0.3 over the entire effective image area (the first to 177-th LEDs 103 in this case) with respect to the exposure area data obtained in the procedure (2), there may be a calculation result that requires a large change in the amounts of light emission depending on the algorithm of the calculation. Therefore, density irregularity occurs even if the inclination is controlled within the set range by the light intensity adjustment.

In this respect, a correction target value for the exposure area that does not cause density irregularity is set.

Figure 14:
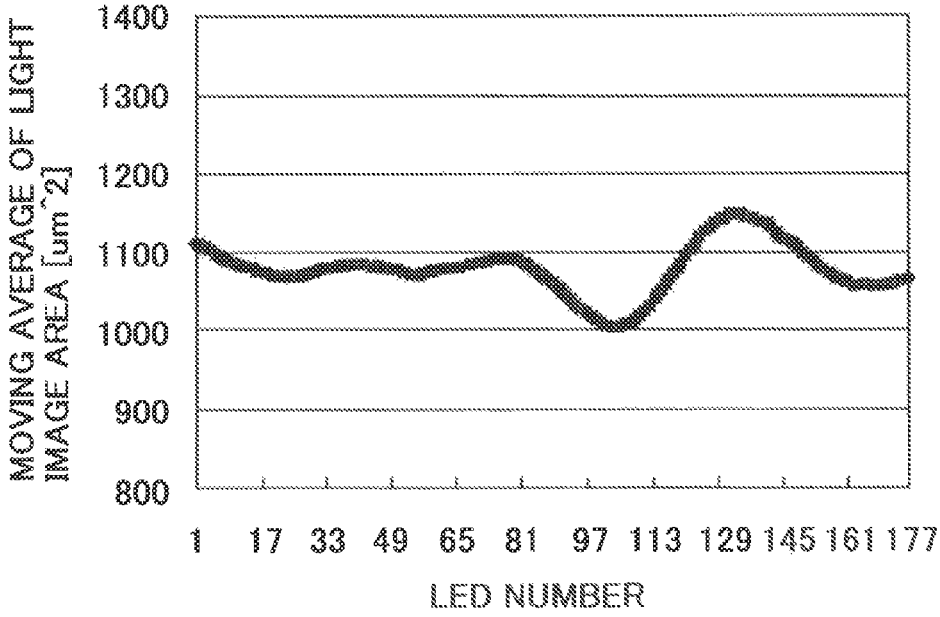
FIG. 14 is a diagram of the correction target value for the LEDs number by number.

(3) For the exposure area, the moving average is acquired for every consecutive 21 LEDs 103. That is, consecutive 21 LEDs 103 are taken as a plurality of light emitting elements, and the moving average is taken as the comparison result. The acquired comparison result is then set as the correction target value as shown in FIG. 14. The moving average is used as the comparison result in this embodiment for the correction target value and the property value (exposure area) to be corrected are in the same unit system so that acquisition of light-intensity correction data explained in the following procedure (4) becomes easy. Therefore, it is favorable to use the moving average as the correction target value.

The correction target value can be set using the inclination of an approximate line. In this case, however, repetitive calculation or the like is needed for the light-intensity correction data and the inclination of an approximate line based on the exposure area in the procedure (4), which somewhat takes time. This is because the property value (exposure area) and the correction target value (inclination) differ in dimension.

Figure 15:
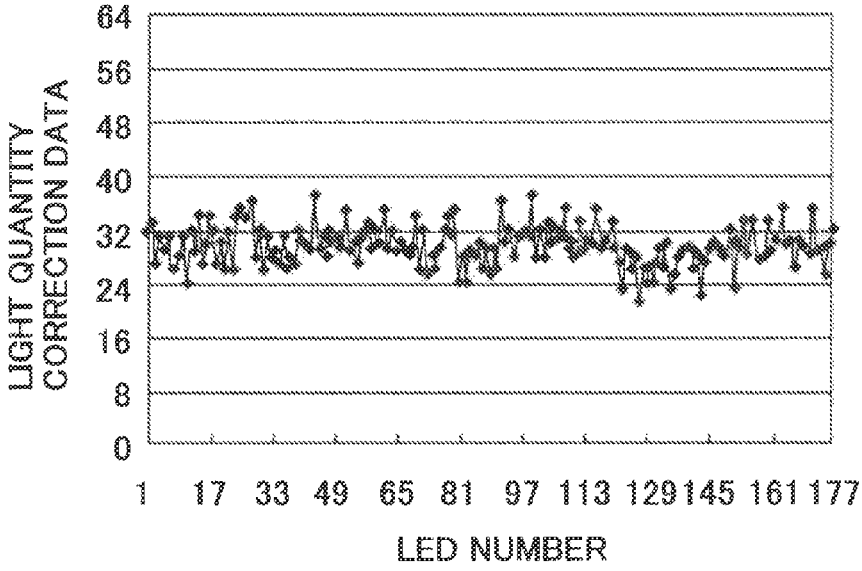
FIG. 15 is a diagram of the light-intensity correction data for the LEDs number by number.

(4) The light-intensity correction data is acquired such that the exposure area for each LED 103 becomes the correction target value obtained in the procedure (3). A specific example of the acquisition method will be explained. Each LED 103 is turned on based on second standard light-intensity correction data and the exposure area is measured. It has been confirmed that the exposure area has a correlation with light-intensity correction data within a certain range of a change in the amount of light emission, and it is recognized that the exposure area actually changes linearly. Therefore, light-intensity correction data that provides the desired exposure area set as the correction target value set in the procedure (3) can be acquired by performing linear interpolation of the measured value of the exposure area for integerization for each LED 103 using the second standard light-intensity correction data. The acquired light-intensity correction data is shown in FIG. 15.

Figure 16:
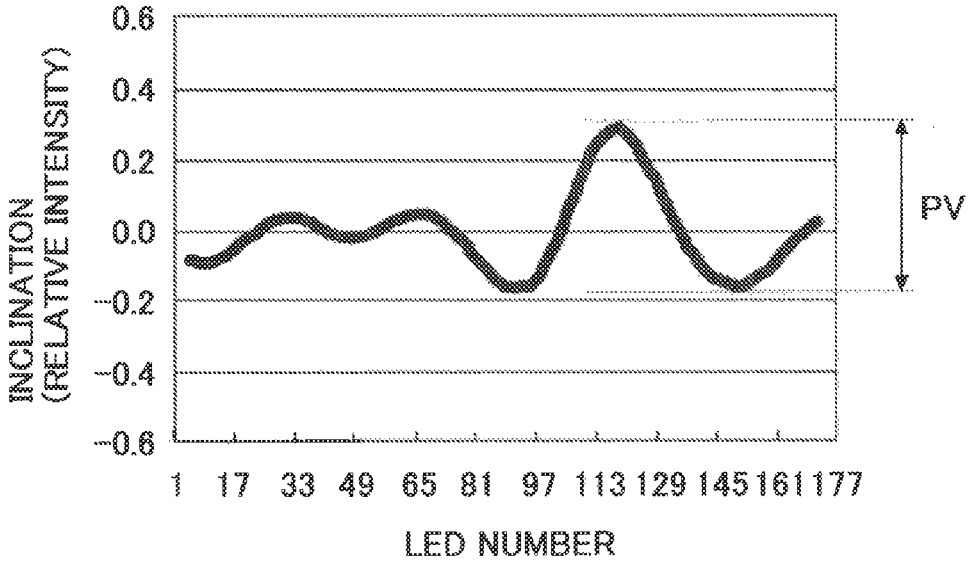
FIG. 16 is a diagram of the inclination of an approximate line for the LEDs number by number.

The inclination of an approximate line is acquired for every consecutive 25 LEDs 103 using the light-intensity correction data. The result is shown in FIG. 16. The PV of the inclination becomes smaller than that in FIG. 13 and lies within the preset range (within ±0.3). That is, density irregularity does not occur.

The distance of the consecutive 25 LEDs 103 at 1200 dots per inch is $$L=24\times0.0212=0.509\text{ mm},$$

while the array pitch of the rod lens array is P=0.56 mm and L/P=0.91.

A fluctuation of the light spot shape is mostly originated from the optical element array (the rod lens array in this example). This is because when the optical axis of one rod lens is inclined or the refractive index distribution changes, for example, the light spot shape is influenced over a range equivalent to the diameter of the rod lens array. For checking the comparison result of the amounts of exposure of a plurality of light emitting elements, therefore, it is easy to recognize a fluctuation of the of the light spot shape originated from the rod lens array by evaluating a change in the distance equivalent to the array pitch of the optical element array. In this respect, it is preferable to set the distance, L, of a plurality of light emitting elements in a way as to satisfy $$0.75\ L \leqq P \leqq 1.25\ L$$

where P is the array pitch of the optical element array.

Where to set the preset range depends on the characteristics of an image forming apparatus to be used. It is therefore necessary to empirically confirm the preset range for an image forming apparatus to be used. Further, it is also necessary to empirically confirm the favorable number of light emitting elements for the comparison result of the amounts of exposure of a plurality of light emitting elements.

Figure 17:
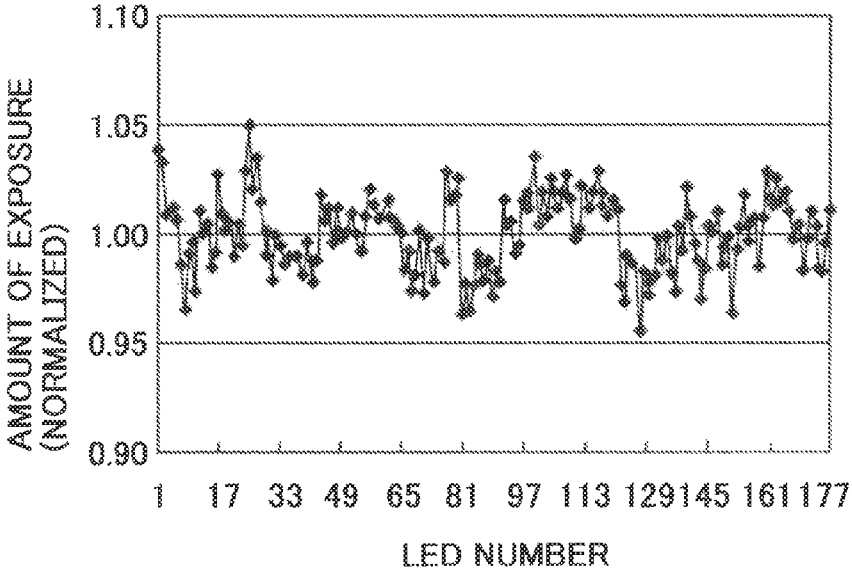
FIG. 17 is a diagram of the amount of exposure for the LEDs number by number.

(5) It is possible to calculate the amount of exposure when each LED 103 is turned on for light emission using the light-intensity correction data acquired in the procedure (4) and acquire a fluctuation of the amount of exposure. The fluctuation of the amount of exposure can be expressed by a fluctuation (%) normalized by, for example, the average value. The fluctuation here is defined as (maximum-minimum)/2. Needless to say, the amount of exposure can be acquired easily by using the relationship between the light-intensity correction data acquired in the procedure (1) and the amount of exposure. The acquired amounts of exposure are shown in FIG. 17. It is apparent from FIG. 17 that the fluctuation of the amount of exposure is ±4.7%.

Whether favorable images are obtained based on the light-intensity correction data obtained in the procedures (1) to (4) can be discriminated by determining if the result exceeds the range, preset according to the image forming apparatus, over the entire effective image area.

Favorable (free from density irregularity) images can be obtained by using the optical writing unit whose amount of light emission is adjusted through the procedures.

The procedures can be used in an inspection to check whether the optical writing unit is acceptable. When the determined result is "no good" (NG) in the procedure (5), the procedures following the procedure (2) can be readjusted by slightly changing the correction target value in the procedure (3). For example, it is possible to put an additional requirement for those light emitting elements that are located near the light emitting element that has caused a fluctuation of the amount of exposure when the determination has resulted in NG or change the number of light emitting elements within the allowable range.

Another light intensity adjusting procedure will be explained below.

(1) The emission condition of each LED is acquired such that the amounts of exposure of light spots on an image carrier after passing the optical system become approximately the same. The emission condition at this time is temporary light-intensity correction data. Temporary light-intensity correction data for a predetermined amount of exposure can be acquired by, for example, turning on each LED 103 based on second standard light-intensity correction data, measuring the amount of exposure and then performs linear interpolation of the measurement for integerization, as mentioned earlier. The acquired temporary light-intensity correction data is shown in FIG. 11. The horizontal axis in the diagram shows the numbers of the LEDs 103 and the results for the consecutive 177 LEDs 103 from the first to the 177-th are shown. The vertical axis in the diagram represents temporary light-intensity correction data that uses six bits (values from 0 to 63) in the embodiment.

(2) The LEDs 103 are turned on for light emission based on the temporary light-intensity correction data and the exposure intensity distribution is measured using a two-dimensional CCD, as mentioned earlier. A predetermined threshold for the 177 LEDs 103 is set to $1/e^2$ of the average value of the peak intensities (average peak exposure intensity) and the exposure area is acquired as the property value. The acquired exposure area is shown in FIG. 12.

FIG. 13 depicts the result of acquiring the inclination of an approximate line for every consecutive 25 LEDs 103. The inclination exceeds a preset range and PV of the inclination is large. Therefore, density irregularity occurs near the 130-th LED 103. Suppose the value of the inclination preset is within ±0.3. If the amounts of light emission are calculated such that the inclination is suppressed to change in the range from −0.3 to 0.3 over the entire effective image area (the first to 177-th LEDs 103 in this case) with respect to the exposure area data obtained in the procedure (2), there may be a calculation result that requires a large change in the amounts of light emission depending on the algorithm of the calculation. Therefore, density irregularity occurs even if the inclination is controlled within the set range by the light intensity adjustment.

In this respect, a correction target value for the exposure area that does not cause density irregularity is set.

(3) For the exposure area, the moving average is acquired for every consecutive 21 LEDs 103. That is, consecutive 21 LEDs 103 are taken as a plurality of light emitting elements, and the moving average is taken as the comparison result. The acquired comparison result is then set as the correction target value as shown in FIG. 14. The moving average is used as the comparison result in this embodiment for the correction target value and the property value (exposure area) to be corrected are in the same unit system so that acquisition of light-intensity correction data explained in the following procedure (4) becomes easy. Therefore, it is favorable to use the moving average as the correction target value.

The correction target value can be set using the inclination of an approximate line. In this case, however, repetitive calculation or the like is needed for the light-intensity correction data and the inclination of an approximate line based on the exposure area in the procedure (4), which somewhat takes time. This is because the property value (exposure area) and the correction target value (inclination) differ in dimension.

(4) The light-intensity correction data is acquired such that the exposure area for each LED 103 becomes the correction target value obtained in the procedure (3). A specific example of the acquisition method will be explained. Each LED 103 is turned on based on second standard light-intensity correction data and the exposure area is measured. It has been confirmed that the exposure area has a correlation with light-intensity correction data within a certain range of a change in the amount of light emission, and it is recognized that the exposure area actually changes linearly. Therefore, light-intensity correction data that provides the desired exposure area set as the correction target value set in the procedure (3) can be acquired by performing linear interpolation of the measured value of the exposure area for integerization for each LED 103 using the second standard light-intensity correction data. The acquired light-intensity correction data is shown in FIG. 15.

The inclination of an approximate line is acquired for every consecutive 25 LEDs 103 using the light-intensity correction data. The result is shown in FIG. 16. The PV of the inclination becomes smaller than that in FIG. 13 and lies within the preset range (within ±0.3). That is, density irregularity does not occur.

The distance of the consecutive 25 LEDs 103 at 1200 dots per inch is $$L=24\times0.0212=0.509\text{ mm},$$

while the array pitch of the rod lens array is P=0.56 mm and L/P=0.91.

A fluctuation of the light spot shape is mostly originated from the optical element array (the rod lens array in this example). This is because when the optical axis of one rod lens is inclined or the refractive index distribution changes, for example, the light spot shape is influenced over a range equivalent to the diameter of the rod lens array. For checking the comparison result of the amounts of exposure of a plurality of light emitting elements, therefore, it is easy to recognize a fluctuation of the of the light spot shape originated from the rod lens array by evaluating a change in the distance equivalent to the array pitch of the optical element array. In this respect, it is preferable to set the distance, L, of a plurality of light emitting elements in a way as to satisfy $$0.75\text{ L}\leqq\text{P}\leqq1.25\text{ L}$$

where P is the array pitch of the optical element array.

Where to set the preset range depends on the characteristics of an image forming apparatus to be used. It is therefore necessary to empirically confirm the preset range for an image forming apparatus to be used. Further, it is also necessary to empirically confirm the favorable number of light emitting elements for the comparison result of the amounts of exposure of a plurality of light emitting elements.

(5) It is possible to calculate the amount of exposure when each LED 103 is turned on for light emission using the light-intensity correction data acquired in the procedure (4) and acquire the comparison result of the amounts of exposure of a plurality of light emitting elements. For example, the inclination of an approximate line can be taken one after another for every consecutive 25 light emitting elements and can be expressed as the comparison result.

Figure 18:
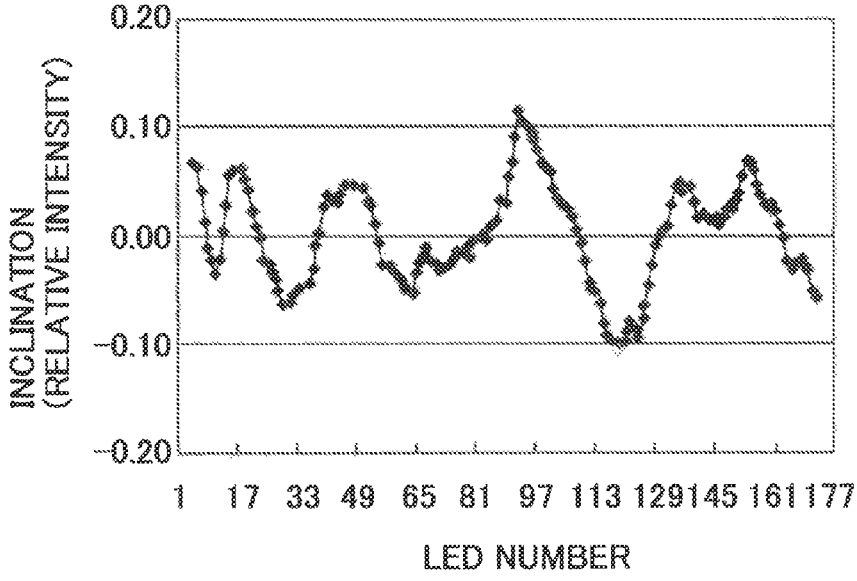
FIG. 18 is a diagram of the inclination of an approximate line for the LEDs number by number.

It is needless to say that the amount of exposure can be acquired easily by using the relationship between the light-intensity correction data acquired in the procedure (1) and the amount of exposure. The acquired amounts of exposure are shown in FIG. 17. The result of acquiring the inclination of an approximate line from the data in FIG. 17 is shown in FIG. 18.

Whether favorable images are obtained based on the light-intensity correction data obtained in the procedures (1) to (4) can be discriminated by determining if the result exceeds the range, preset according to the image forming apparatus, over the entire effective image area.

When an abrupt change occurs locally in the amount of exposure, in particular, the change can be extracted by obtaining the acquisition of the inclination of an approximate line.

As the number of light emitting elements for which an approximate line is to be taken changes, the comparison result obtained naturally changes. Therefore, with very few light emitting elements in use, an abrupt change in the amount of exposure for one light emitting element or the like can be recognized, whereas with the number of light emitting elements being increased, a change in the amount of exposure in a certain range can be recognized.

It is desirable that the number of light emitting elements is selected beforehand in accordance with the characteristics of the optical writing unit, the image forming apparatus or the like. It is also possible to acquire the comparison result for each of several numbers of light emitting elements and determine the best combination. This can improve the determination accuracy.

Favorable (free from density irregularity) images can be obtained by using the optical writing unit whose amount of light emission is adjusted through the procedures.

The procedures can be used in an inspection to check whether the optical writing unit is favorable. When the determination result becomes NG in the procedure (5), the procedures following the procedure (2) can be readjusted by slightly changing the correction target value in the procedure (3). For example, it is possible to put an additional requirement for those light emitting elements that are located near the light emitting element that has caused a fluctuation of the amount of exposure when the determination has resulted in NG or change the number of light emitting elements within the allowable range.

Still another light intensity adjusting procedure will be explained below.

(1) The emission condition of each LED is acquired such that the amounts of exposure of light spots on an image carrier after passing the optical system become approximately the same. The emission condition at this time is temporary light-intensity correction data. Temporary light-intensity correction data for a predetermined exposure area can be acquired by, for example, turning on each LED 103 based on second standard light-intensity correction data, measuring the exposure area and then performs linear interpolation of the measurement for integerization, as mentioned earlier.

(2) The LEDs 103 are turned on for light emission based on the temporary light-intensity correction data and the amounts of exposure is measured. If the amounts of light emission are calculated such that the result of acquiring the inclination of an approximate line for every consecutive 25 LEDs 103 is suppressed within the preset range of the inclination, there may be an instance that a large change in exposure area is needed, depending on the algorithm of the calculation.

In this respect, a correction target value for the amounts of exposure that does not cause density irregularity is set.

(3) For the amounts of exposure, the moving average is acquired for every consecutive 21 LEDs 103. That is, consecutive 21 LEDs 103 are taken as a plurality of light emitting elements, and the moving average is taken as the comparison result. The acquired comparison result is then set as the correction target value. Needless to say, the correction target value may be set using another type of comparison result, such as the inclination of an approximate line.

(4) The light-intensity correction data is acquired such that the exposure area for each LED 103 becomes the correction target value obtained in the procedure (3). As one example of the specific acquisition method, as explained above, light-intensity correction data that provides the desired amount of exposure set as the correction target value set in the procedure (3) can be acquired by performing linear interpolation of the measured value of the exposure area for integerization for each LED 103 using the second standard light-intensity correction data. The result of acquiring the inclination of an approximate line for every consecutive 25 LEDs 103 using the light-intensity correction data is smaller than the result acquired in the procedures (2), and lies within the preset range. Therefore, density irregularity does not occur.

Where to set the preset range depends on the characteristics of an image forming apparatus to be used. It is therefore necessary to empirically confirm the preset range for the image forming apparatus to be used. Further, it is also necessary to empirically confirm the favorable number of light emitting elements for the comparison result of the amounts of exposure of a plurality of light emitting elements.

(5) It is possible to calculate the exposure area when each LED 103 is turned on for light emission using the light-intensity correction data acquired in the procedure (4) and acquire the comparison result of the exposure areas of a plurality of light emitting elements. For example, the inclination of an approximate line can be taken one after another for every consecutive 25 light emitting elements and can be expressed as the comparison result. The exposure area can be acquired easily by using the relationship between the light-intensity correction data acquired in the procedure (1) and the exposure area, and the inclination of an approximate line can be acquired easily by using the result.

Whether favorable images are obtained based on the light-intensity correction data obtained in the procedures (1) to (4) can be discriminated by determining if the result exceeds the range, preset according to the image forming apparatus, over the entire effective image area.

Favorable (free from density irregularity) images can be obtained by using the optical writing unit whose amount of light emission is adjusted through the procedures.

The comparison result of the property values of a plurality of light emitting elements at a predetermined threshold in the exposure intensity distribution and the comparison result of the amounts of exposure of the light emitting elements in the invention may take the same index (the inclination of an approximate line or the moving average or the like), or may take different ones. The number of light emitting elements that is needed to acquire the comparison result of the property values of a plurality of light emitting elements at a predetermined threshold in the exposure intensity distribution and the number of light emitting elements that is needed to acquire the comparison result of the amounts of exposure of the light emitting elements may be the same or may be different from each other.

The index used as the comparison result and the number of light emitting elements can be selected beforehand according to the characteristics of the optical writing unit, the image forming apparatus or the like. In other words, the conditions for acquiring favorable (free from density irregularity) images is empirically obtained.

Figure 1:
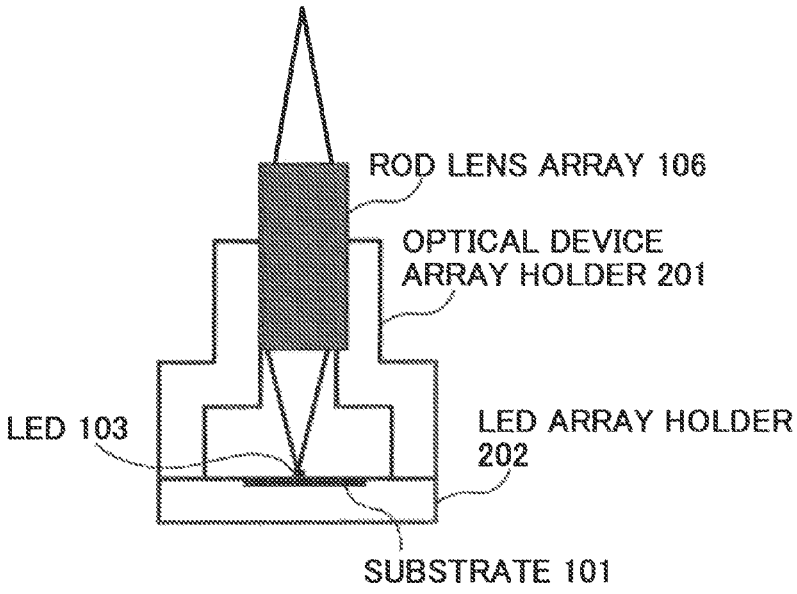
FIG. 1 is a diagram of an optical writing unit according to the present invention.

Although the optical writing unit according to this embodiment includes the light-emitting-element array having inorganic LEDs 103 and an optical system having a rod lens array as shown in FIG. 1, the invention is in no way limited to the light-emitting-element array and the optical system of the present embodiment.

As the light-emitting-element array, a self-emitting device array, such as a liquid crystal shutter array or an organic EL array (also called "organic LED array"), can be used beside the LED array. In particular, the organic EL array has an advantage that does not takes the structure of the inorganic LED array having an array of LED array chips as shown in FIG. 2, but it can be produced by integrally arraying organic EL devices over the entire effective image area. Of the fluctuations of light spots, the positional fluctuation, in particular, does not cause any problem (whereas the LED array chip has a problem that the positional fluctuation of a light spot occurs due to the chip mounting error, producing vertical lines.)

Figure 19A:
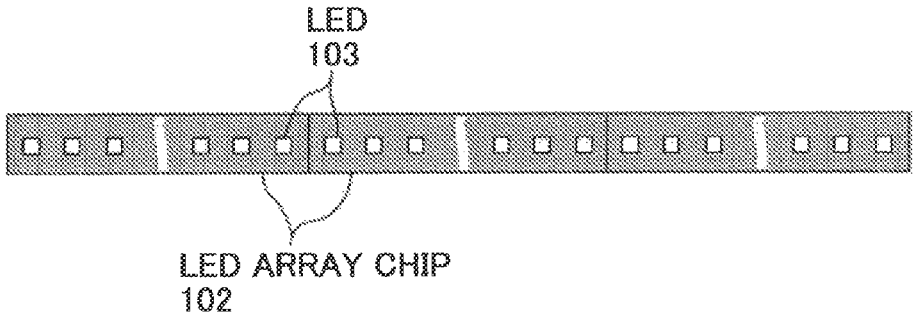
FIG. 19A is a schematic diagram of an LED array having light emitting elements arrayed in a line.
Figure 19B:
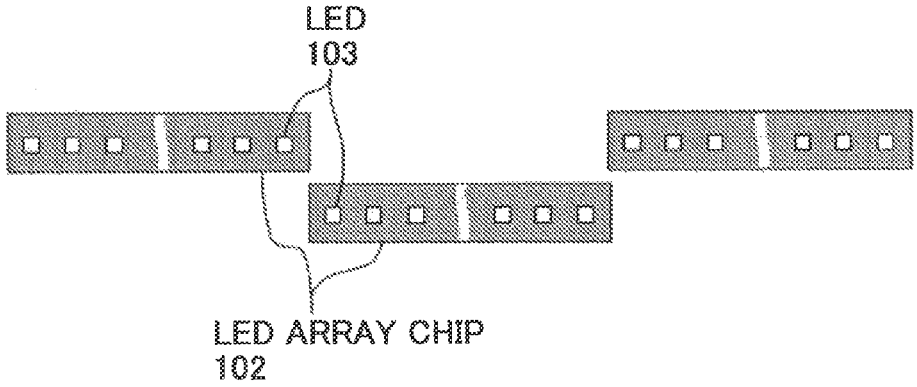
FIG. 19B is a schematic diagram of LED array chips arranged in a zigzag form.
Figure 19C:
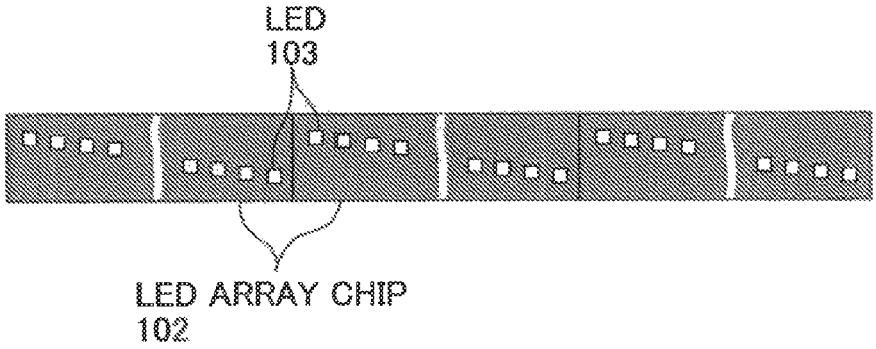
FIG. 19C is a schematic diagram of an LED array chip having light emitting elements mounted obliquely.

There are an LED array 103 that has light emitting elements arrayed in a line (FIG. 19A), and an LED array 103 that has the LEDs 103 arrayed in a zigzag form (FIG. 19B). There is another type that has the light emitting elements mounted inclined according to the rotational speed of the photoconductor (FIG. 19C).

Further, some organic EL arrays include a light-emitting-element array in which light emitting elements are relatively easily arrayed in plural rows. There are various modes of arraying light emitting elements in light-emitting-element arrays.

There are several optical systems including a type where one optical device corresponds to one light emitting element, a type where one optical device is associated with several light emitting elements, and a type, such as a rod lens array, where an erecting system is formed in the array direction and a flux of rays emitted from one light emitting element pass through a plurality of light emitting elements. Those types will be explained below with reference to simple schematic diagrams.

Figure 20A:
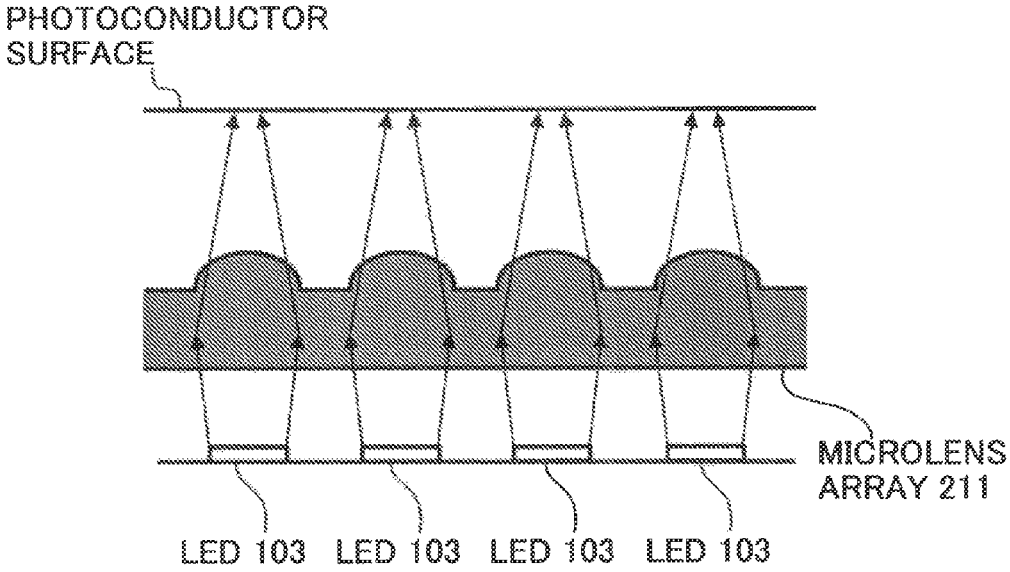
FIG. 20A is a schematic diagram of a microlens array type where optical devices are arrayed at the same pitch as an array of light emitting elements.
Figure 20B:
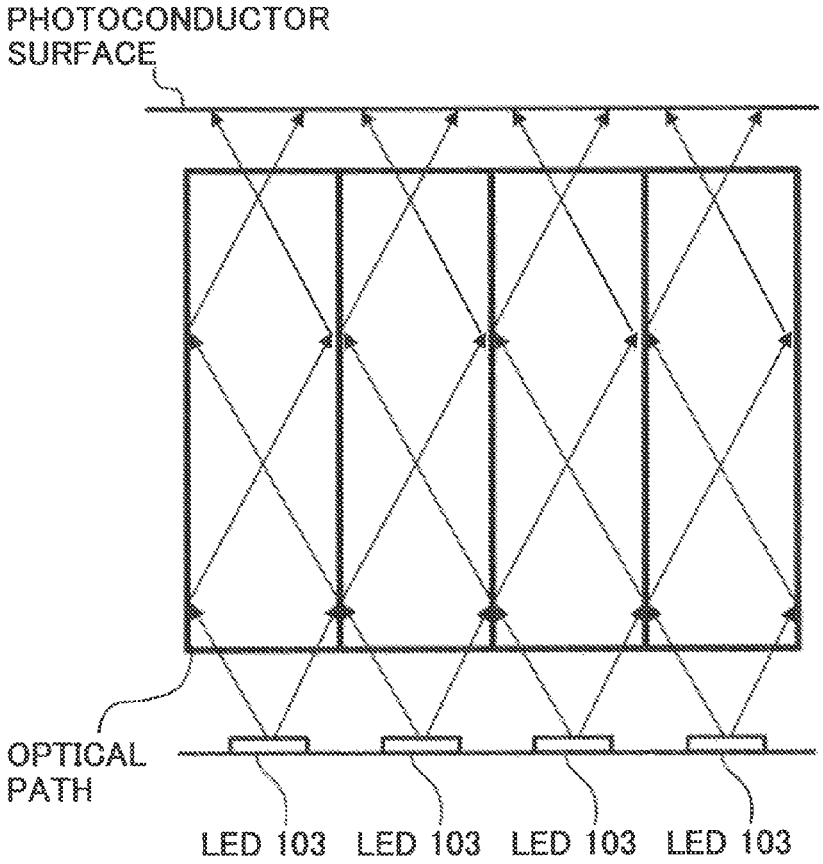
FIG. 20B is a schematic diagram of a waveguide type that does not form an image but guides a flux of rays.

As shown in FIGS. 20A and 20B, there are a microlens array 211 where optical devices are arrayed at the same pitch as the light-emitting-element array (FIG. 20A), and a waveguide type that does not form an image but guides a flux of rays (FIG. 20B), both the type where one optical device corresponds to one light emitting element.

Figure 21:
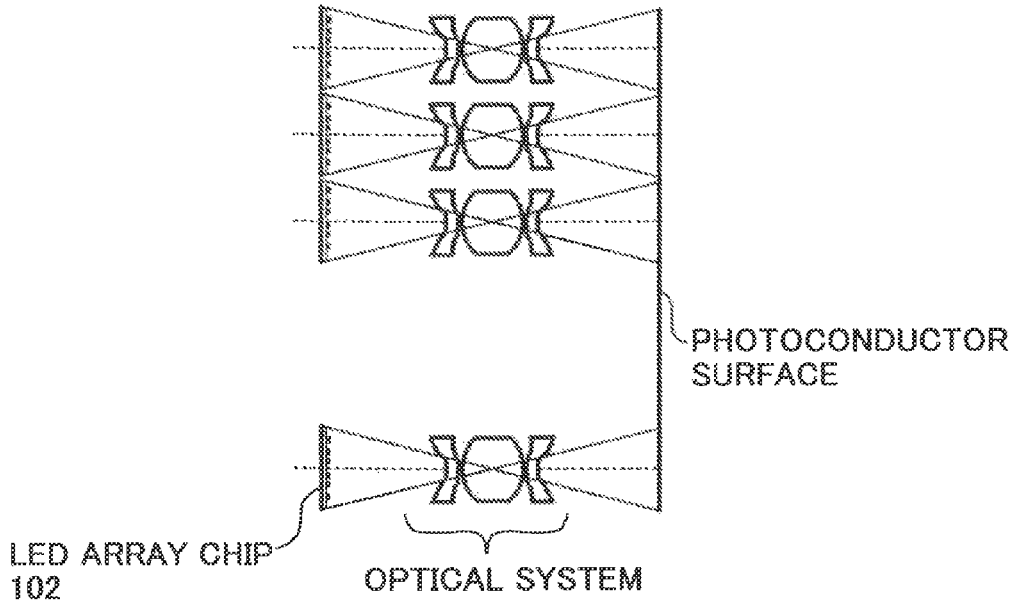
FIG. 21 is a schematic diagram of a type where a lens array is comprised of a plurality of lenses and an inverting system is formed in the array direction, as a type where one optical device corresponds to several light emitting elements.

As shown in FIG. 21, there is another type where a lens array is comprised of a plurality of lenses and an inverting system is formed in the array direction, as the type where one optical device is associated with several light emitting elements. In this example, three inverting systems are used for each LED array chip.

Figure 22:
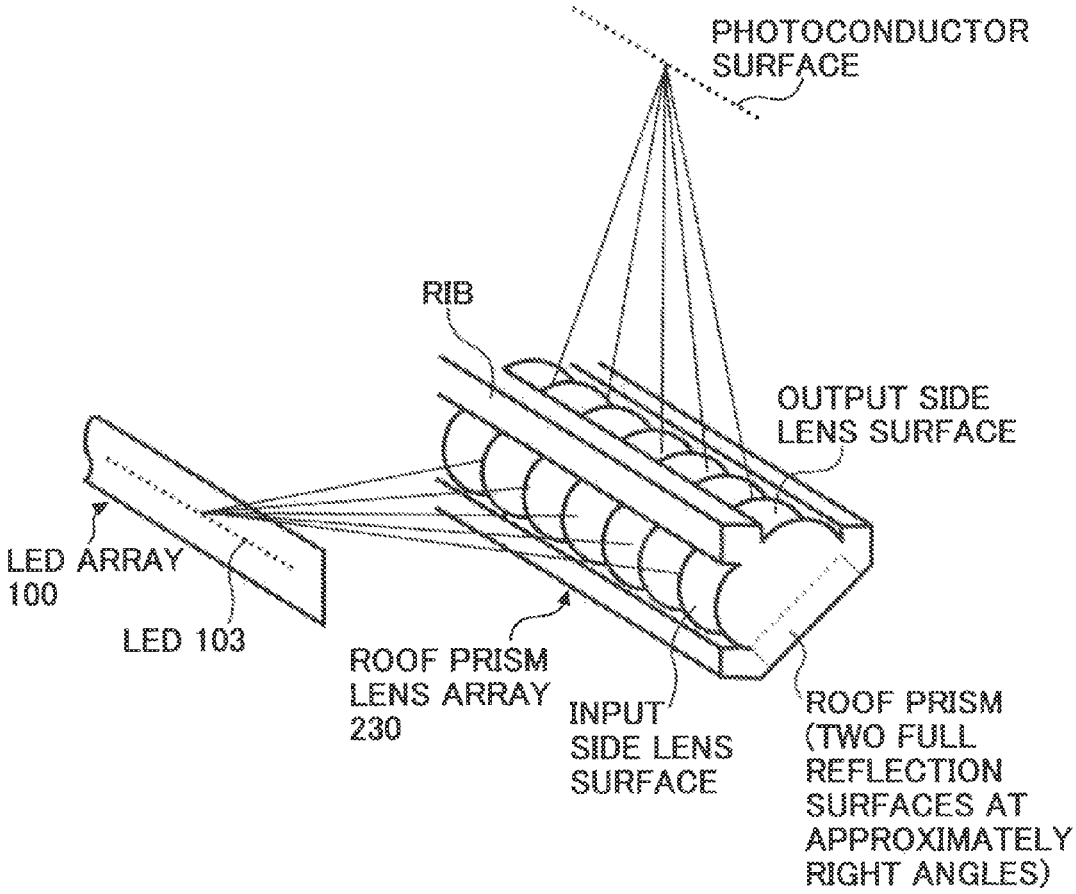
FIG. 22 is a schematic diagram of a type where a roof prism lens array is used in addition to a rod lens array, as a type where a flux of rays emitted from a single light emitting element passes through a plurality of optical devices.

There is a further type, as shown in FIG. 22, where a roof prism lens array 220 is used in addition to the rod lens array, as the type where a flux of rays emitted from a single light emitting element passes through a plurality of optical devices.

The present embodiment relates to an optical writing unit with the desired emission conditions set, and a light intensity adjusting method for light emitting elements, and does not depend on the mode of the optical writing unit. Therefore, the embodiment can be modified in various forms without departing from the spirit of the invention.

Figure 23:
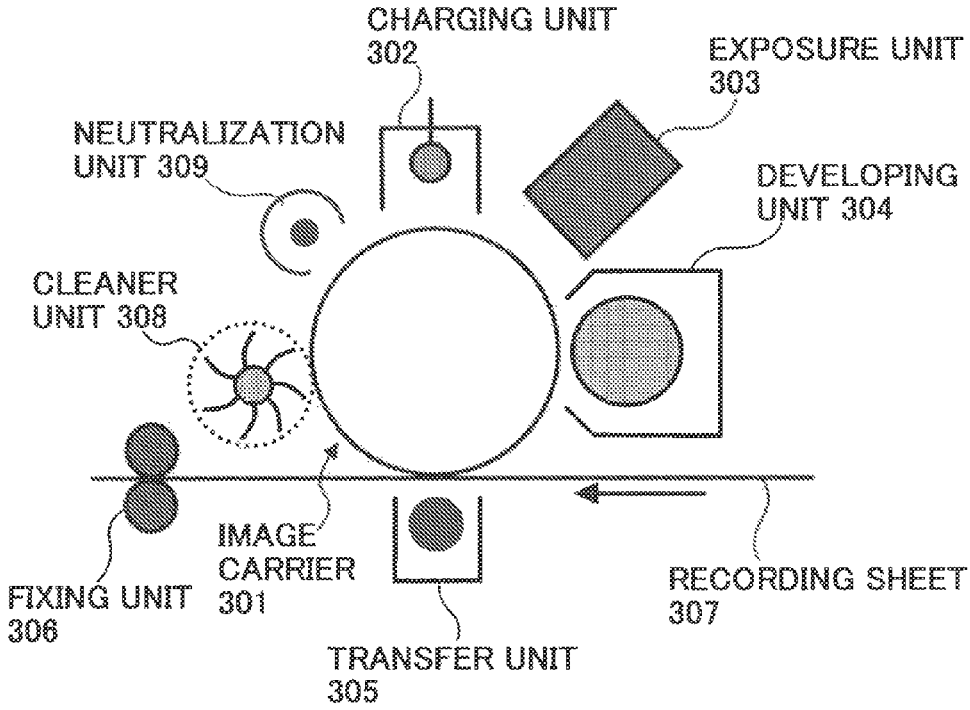
FIG. 23 is a schematic structural diagram of an image forming apparatus.

An image forming apparatus is shown in FIG. 23.

An electrophotography process is one of image forming processes to form an image in an image forming apparatus. The electrophotography process will be briefly described below.

According to the electrophotography process, a potential is applied to an image carrier (e.g., a photoconductor) 301 by a charging unit 302 (charging process), a light spot from an optical writing unit (exposure unit) is irradiated on the image carrier 301 to form a latent image (exposure process), toners are applied to the latent image by a developing unit 304 (developing process), the resultant toner image is transferred on a recording sheet 307 by a transfer unit 305 (transfer process), the recording sheet 307 is then applied with pressure or heat by a fixing unit 306 to be fixed on the recording sheet 307 (fixing process). The toners remaining on the image carrier are cleaned off by a cleaner unit 308, and the charged portion is neutralized by a neutralization unit 309. The optical writing unit according to the invention can be adapted to a tandem type image forming apparatus that is advantageous for fast outputting of color images.

Figure 24:
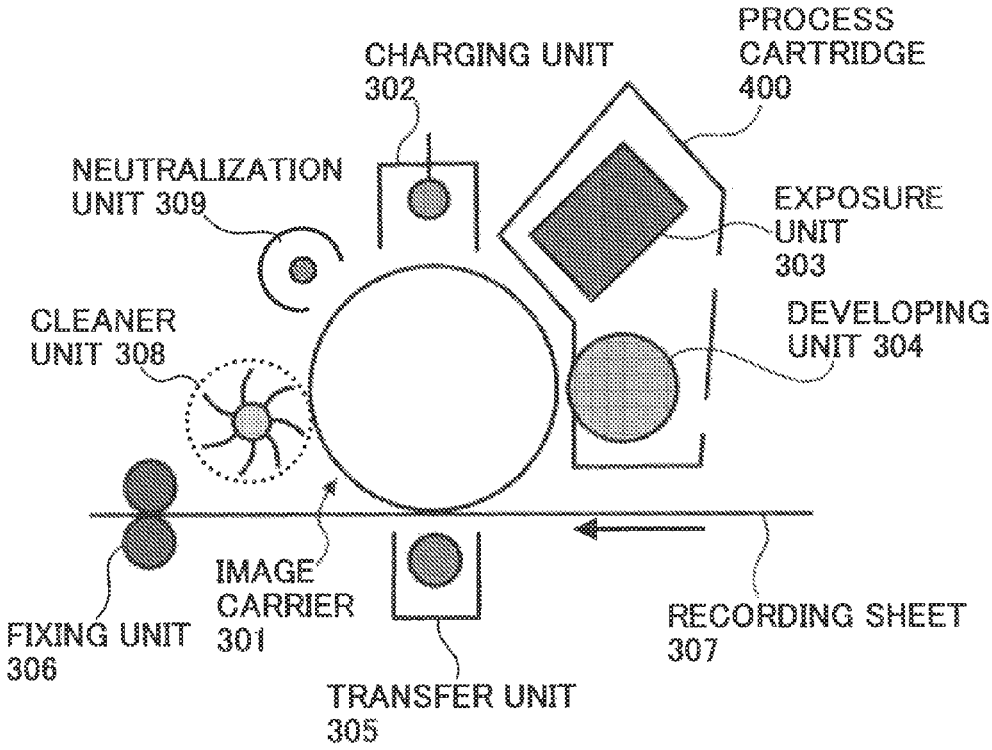
FIG. 24 is a schematic structural diagram of an image forming apparatus having a process cartridge.
Figure 25:
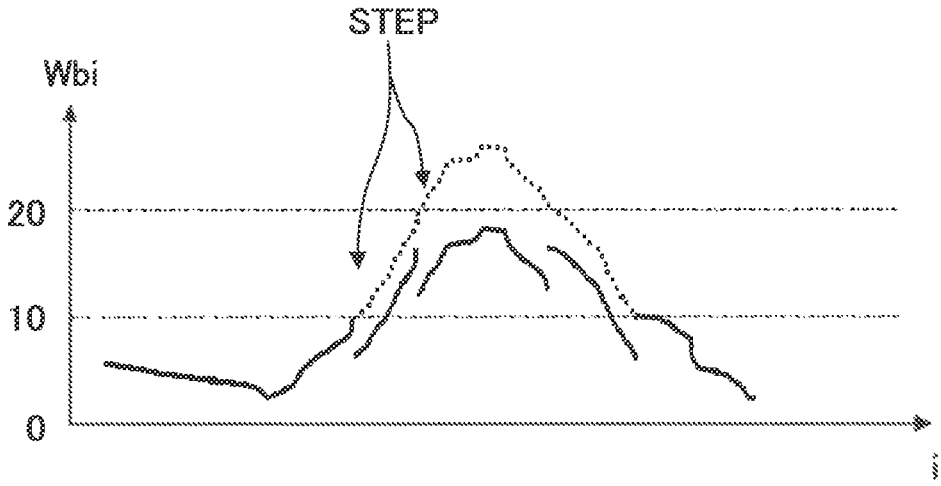
FIG. 25 is an image diagram of Wbi.

An image forming apparatus having a process cartridge is shown in FIG. 24.

In FIG. 24, the exposure unit 303 and the developing unit 304 are integrally supported on a process cartridge 400, which is designed in such a way as to be attachable to and detachable from the image forming apparatus. This example is not restrictive, and at least one unit (not shown) selected from the exposure unit 303, the image carrier 301, the charging unit 302, and the developing unit 304 can be integrally supported on the process cartridge to be attachable to and detachable from the image forming apparatus.

As explained above, according to the embodiment, the present invention provides an optical writing unit that suppresses a fluctuation of the intensity as well as a fluctuation of the light spot shape, prevents the property values of nearly light emitting elements from rapidly changing and has those factors optimally corrected over the entire effective image area, an image forming apparatus that uses the optical writing unit, a process cartridge that uses the optical writing unit, and a light intensity adjusting method for the optical writing unit.

According to the present invention, there is provided an optical writing unit that sets an emission condition of a plurality of light emitting elements such that the result of comparison of property values of the light emitting elements at a predetermined threshold in an exposure intensity distribution of the light emitting elements lies within a preset range over an entire effective image area, and a fluctuation of amounts of exposure of the light emitting elements does not exceed a preset range over the entire effective image area. This suppresses not only a fluctuation of the spot shape but also a fluctuation of intensity and prevents a rapid change in property values of nearby light emitting elements, thereby ensuring acquisition of favorable images without density irregularity.

Furthermore, according to the second aspect of the present invention, there is provided an optical writing unit that sets an emission condition of a plurality of light emitting elements such that the result of comparison of property values of the light emitting elements at a predetermined threshold in an exposure intensity distribution of the light emitting elements lies within a preset range over an entire effective image area, and the result of comparison of amounts of exposure of the light emitting elements does not exceed a preset range over the entire effective image area. Accordingly, the comparison result for a plurality of light emitting elements can be corrected optimally for not only a fluctuation of the spot shape but also a fluctuation of intensity, and a rapid change in property values of nearby light emitting elements can be avoided, thereby ensuring acquisition of favorable images free from density irregularity.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An optical writing unit, comprising:

a light-emitting-element array including a plurality of individual light emitting elements that are arranged; and an optical system that guides light flux emitted from the light emitting elements as a light spot, wherein an emission condition of each of the individual light emitting elements is individually set, such that a result of comparison of a property value of the light emitting elements at a predetermined threshold in an exposure intensity distribution of the light emitting elements is within a preset range over an entire effective image area, and such that an amount of fluctuation of exposure of the light emitting elements or a result of comparison of the amounts of exposure does not exceed a preset range over the entire effective image area.

2. The optical writing unit according to claim 1, wherein the result of comparison of the property value is for a plurality of sequential light emitting elements.

3. The optical writing unit according to claim 1, wherein the property value is a dimension of an exposure area.

4. The optical writing unit according to claim 1, wherein the result of comparison of the property value is an inclination of an approximate line.

5. The optical writing unit according to claim 1, wherein the optical system is an optical element array in which a plurality of optical elements is arranged, the light flux emitted from a single light emitting element of the plurality of light emitting elements forms a light spot through the optical elements, and the optical element array forms an erecting system in an array direction.

6. The optical writing unit according to claim 1, wherein the light emitting elements are organic light-emitting-diodes.

7. The optical writing unit according to claim 1, wherein the emission condition includes light-intensity correction data that determines a current, a voltage, a resistance, or an emission time for each of the light emitting elements.

8. The optical writing unit according to claim 1, wherein the emission condition of each of the individual light emitting elements is set to reduce fluctuation of light intensity and fluctuation of the light spot shape.

9. The optical writing unit according to claim 1, wherein the amount of fluctuation of exposure is measured by a percentage of fluctuation based on comparing an exposure amount of a particular light emitting element to an average value of exposure determined by a highest amount of exposure subtracted by a lowest amount of exposure, divided by two.

10. An image forming apparatus comprising an image forming process unit including a charging unit, an exposure unit, a developing unit, a transfer unit, and a fixing unit, wherein the exposure unit includes a light-emitting-element array including a plurality of individual light emitting elements that are arranged and an optical system that guides light flux emitted from the light emitting elements as a light spot, an emission condition of each of the light emitting elements is individually set based on light intensity correction data, such that a result of comparison of a property value of the light emitting elements at a predetermined threshold in an exposure intensity distribution of the light emitting elements is within a preset range over an entire effective image area, and such that an amount of fluctuation of exposure of the light emitting elements or a result of comparison of the amounts of exposure does not exceed a preset range over the entire effective image area.

11. A process cartridge, comprising:

an exposure unit that is integrally held with the process cartridge and any one of an image carrier, a charging unit, and a developing unit, and is detachably mounted on a main unit of an image forming apparatus, wherein an emission condition of each of the light emitting elements is individually set based on light intensity correction data, such that a result of comparison of a property value of the light emitting elements at a predetermined threshold in an exposure intensity distribution of the light emitting elements is within a preset range over an entire effective image area, and such that an amount of fluctuation of exposure of the light emitting elements or a result of comparison of the amounts of exposure does not exceed a preset range over the entire effective image area.

12. A method of adjusting light intensity, comprising:

extracting a first emission condition that makes amounts of exposure of individual light emitting elements of a plurality of light emitting elements identical, the first emission condition being temporary light-intensity correction data;

emitting the light emitting elements using the temporary light-intensity correction data;

measuring the property value of the light emitting elements at a predetermined threshold in an exposure intensity distribution of the light emitting elements;

setting a result of comparison of the property value of the light emitting elements as a correction target value;

extracting a second emission condition to achieve a correction target value, the second emission condition being light-intensity correction data; and setting an emission condition of each of the light emitting elements individually based on the light-intensity correction data, such that a result of comparison of a property value of the light emitting elements at a predetermined threshold in an exposure intensity distribution of the light emitting elements is within a preset range over an entire effective image area, and an amount of fluctuation of exposure of the light emitting elements or a result of comparison of the amounts of exposure does not exceed a preset range over the entire effective image area.

13. The method according to claim 12, wherein the correction target value is a moving average of the property value for the light emitting elements.

14. An optical writing unit, comprising:

a light-emitting-element array including a plurality of individual light emitting elements that are arranged; and an optical system that guides light flux emitted from the light emitting elements as a light spot, wherein a result of comparison of a property value of the light emitting elements at a predetermined threshold in an exposure intensity distribution of the light emitting elements is within a preset range over an entire effective image area, and such that an amount of fluctuation of exposure of the light emitting elements or a result of comparison of the amounts of exposure does not exceed a preset range over the entire effective image area, wherein the result of comparison of the property value is a moving average of twenty one sequential light emitting elements.

* * * * *